US009482242B1

(12) United States Patent
Mares et al.

(10) Patent No.: US 9,482,242 B1
(45) Date of Patent: Nov. 1, 2016

(54) C-CONNECT FASTENER FOR A CEILING FAN BLADE

(71) Applicant: LITEX INDUSTRIES, LIMITED, Grand Prairie, TX (US)

(72) Inventors: John F Mares, Grand Prairie, TX (US); Ming Chi Lin, Taichung (TW)

(73) Assignee: LITEX INDUSTRIES, LIMITED, Grand Prairie, TX (US)

( * ) Notice: Subject to any disclaimer, the term of this patent is extended or adjusted under 35 U.S.C. 154(b) by 512 days.

(21) Appl. No.: 14/095,262

(22) Filed: Dec. 3, 2013

(51) Int. Cl.
*F04D 29/34* (2006.01)
*F04D 29/64* (2006.01)
*F04D 29/32* (2006.01)

(52) U.S. Cl.
CPC ..... *F04D 29/644* (2013.01); *F04D 29/322* (2013.01)

(58) Field of Classification Search
CPC ..... F04D 25/088; F04D 29/34; F04D 29/36; F04D 29/322; F04D 29/323; F04D 29/646; F16B 21/18; F16B 21/186; Y10T 403/604; Y10T 403/7037; Y10T 403/7073; Y10T 403/75
USPC ..... 416/210 R, 207; 411/517, 522
See application file for complete search history.

(56) References Cited

U.S. PATENT DOCUMENTS

| | | | | |
|---|---|---|---|---|
| 6,241,476 | B1 | 6/2001 | Lee | |
| 6,336,792 | B1 | 1/2002 | Bucher et al. | |
| 6,802,694 | B2 | 10/2004 | Bucher et al. | |
| 6,821,091 | B2 | 11/2004 | Lee | |
| 7,223,078 | B1 | 5/2007 | Mares et al. | |
| 7,351,037 | B1 | 4/2008 | Mares et al. | |
| 8,099,833 | B2 * | 1/2012 | Duan | F16B 21/186 16/337 |

* cited by examiner

*Primary Examiner* — Eric Keasel
*Assistant Examiner* — Jason Mikus
(74) *Attorney, Agent, or Firm* — Mark W Handley

(57) ABSTRACT

C-connect fasteners (24) are provided for securing ceiling fan blades (26) to mounting brackets (20). Protuberant members (32) extend from the mounting brackets (20), and have heads (72) and shanks (74) which fit through apertures (62) in the ceiling fan blades (26). The C-connect fasteners (24) have an upper surface (36), a lower surface (38), and a peripheral edge (40) extending between the upper and lower surfaces (36, 38). An C-shaped opening (46) is formed in the peripheral edge (40) for sliding around the shank (74) and wedging the C-connect fastener (24) between the head (72) of the protuberant member (32) and the upper surface of ceiling fan blade (26). Resilient tabs (52) are spaced about the peripheral edge (40) the C-connect fastener (24) and press the upper surface (36) of the C-connect fastener (24) into the head (72) of the protuberant member (32).

15 Claims, 5 Drawing Sheets

C-CONNECT FASTENER FOR A CEILING FAN BLADE

TECHNICAL FIELD OF THE INVENTION

The present invention relates in general to ceiling fans, and in particular to fasteners for firmly fastening fan blades to mounting brackets of ceiling fan motors.

BACKGROUND OF THE INVENTION

Prior art quick-connect fasteners for firmly fastening fan blades to mounting brackets connected to rotors of ceiling fan motors have been disclosed in U.S. Pat. No. 7,351,037, U.S. Pat. No. 7,223,078, U.S. Pat. No. 6,241,476, U.S. Pat. No. 6,336,792, U.S. Pat. No. 6,821,091, and U.S. Pat. No. 6,802,694. One of these prior art patents discloses that the ceiling fan blade which is moved lineally away from the ceiling fan blade to engage a spring clip lock member against an edge of the ceiling fan blade to latch the blade to a motor mounting bracket. Others of the prior art patent disclosures have fastening means which require that a fastening clip or a fastening plate be moved lineally relative to the ceiling fan blade to firmly fasten the blade to one of the motor mounting brackets. Still others of these prior art patents disclose rotary fasteners having several C-shaped openings which engage in recesses in mounting posts that extend from fan blade arms and pass through through-holes in the fan blades. The rotary fasteners are rotated to engage the C-shaped openings with the recesses in the mounting posts.

SUMMARY OF THE INVENTION

A novel C-connect fastener is disclosed for providing a quick connect fastener which firmly fastens fan blades to ceiling fan motor mounting brackets. The mounting brackets are mounted to a ceiling fan rotor. A plurality of protuberant members extend upwards from the outward ends of each of the mounting brackets. The protuberant members have shank portions and head portions which fit through apertures in the ceiling fan blades. The C-connect fasteners are provided by a single molded plastic part formed in a C-shaped configuration for fitting around shank portions of the protuberant members and wedging between outward surfaces of the ceiling fan blades and the head portions of the protuberant members. The C-connect fasteners have a body with an upper surface, a substantially planar lower surface, and peripheral edge portions extending between the upper and lower surfaces. The peripheral edge portions include an opening which is preferably C-shaped. The openings are aligned for sliding the opening around the shank portion of one of the protuberant members, and pressing the C-connect fastener between the head portion of one of the protuberant members and the upper surface of ceiling fan blade. Three resilient tabs are spaced apart about the peripheral edge of the body of the C-connect fastener and provide spring-like protrusions which engage an outward surface of the ceiling fan blade to bias the C-connect fastener into a position which is spaced apart from the surface of the ceiling fan blade and press the upper surface of the C-connect fastener into the head portion of the protuberant member to lock the ceiling fan blades to the mounting brackets.

DESCRIPTION OF THE DRAWINGS

For a more complete understanding of the present invention and the advantages thereof, reference is now made to the following description taken in conjunction with the accompanying Drawings in which

FIG. 1 is a partial perspective view of a ceiling fan having fan blades mounted to a ceiling fan motor with mounting brackets and having a plurality of C-connect fasteners firmly securing the fan blades to respective ones of the mounting brackets;

FIG. 2 is a partial perspective view of one of the ceiling fan blades firmly fastened to a mounting bracket arm by means of three of the C-connect fasteners and protuberant members;

FIG. 3 is an exploded view of the mounting bracket arm, protuberant members which extend from the mounting bracket arm, an inward end portion of the fan blade and the C-connect fasteners;

FIG. 4 is a partial section view taken along Section Line 4-4 of FIG. 2 of the fan blade, the mounting bracket arm, one of the C-connect fasteners, and a protuberant member which includes a threaded fastener and a bushing;

FIG. 5 is an exploded, partial section view taken along Section Line 4-4 of FIG. 2 of the fan blade, the mounting bracket arm, the threaded fastener, the bushing and the C-connect fastener;

FIGS. 6 and 7 are perspective views of one of the C-connect fasteners;

FIG. 8 is a top view of the C-connect fastener with the protuberant member shown in phantom;

FIG. 9 is a side elevation view of the C-connect fastener;

FIG. 10 is a perspective view looking upward beneath the bottom side of the C-connect fastener; and FIG. 11 is a partial, section view of the C-connect fastener, taken along Section Line 11-11 of FIG. 10.

DETAILED DESCRIPTION OF THE INVENTION

Figure 1:
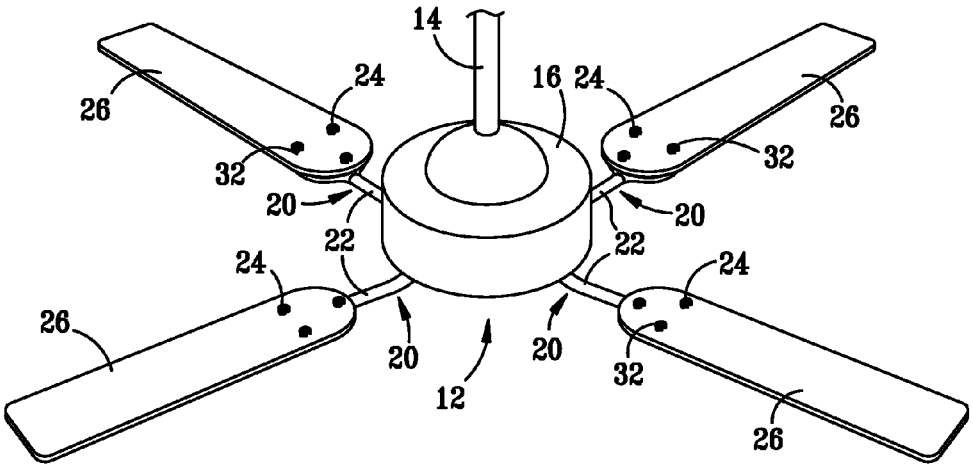
FIGS. 1 through 11 show various aspects for C-connect fastener for ceiling fan blades made according to the present invention, as set forth below.
Figure 2:
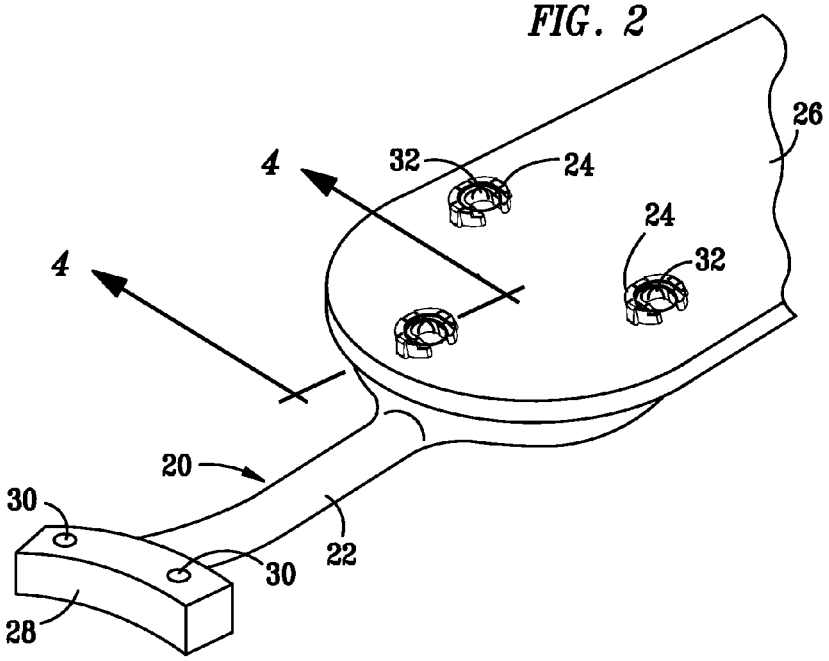

Referring to the Figures, FIG. 1 is a perspective view of a ceiling fan 12, and FIG. 2 is a partial perspective view of a ceiling fan blade 26 and a mounting bracket 20 for securing the fan blade 26 to a fan motor. The ceiling fan 12 has a down rod 14, a motor housing 16 and a plurality of the fan blades 26. The mounting brackets 20 are mounted to a motor of the ceiling fan 12 and include mounting arms 22. The fan blades 26 are each firmly fastened to the mounting brackets 20 by three C-connect fasteners 24 and protuberant members 32. The mounting bracket arm 22 includes an arcuately shaped connector plate 28 having mounting holes 30 for firmly fastening the connector plate 28 to the motor of the ceiling fan 12. Protuberant members 32 extend upwards from the mounting bracket arm 22, through the fan blade 26, and protrude from the fan blade 26. The C-connect fasteners 24 are wedged between heads 72 of the protuberant members 32 and an upper surface of the fan blade to secure the fan blades 26 to the mounting brackets 20.

Figure 3:
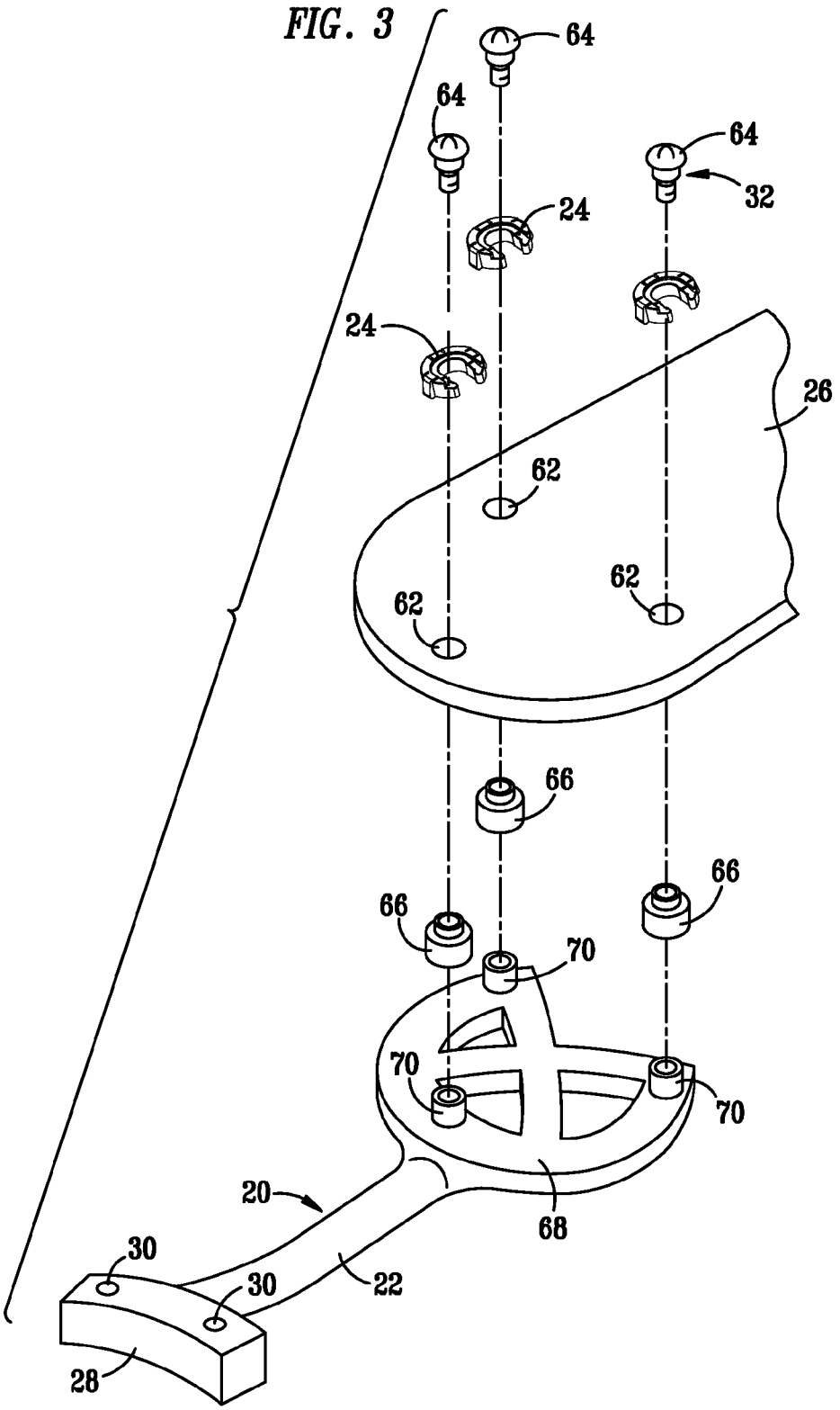

FIG. 3 is an exploded view of the mounting bracket arm 22 and an inward end portion of the fan blade 26. The fan blade 26 has apertures 62 which are through-holes for passing the protuberant members 32 through the fan blade 26, which preferably extend upward from the mounting bracket arm 22. The mounting bracket arm 22 has a mounting portion 68, or enlarged body portion, which provides a support member against which one side of the fan blade 26 is mounted. Three bosses 70 are preferably integrally formed with the mounting portion 68 and extend upward therefrom in a spaced apart alignment for registering with the apertures 62 in the fan blade 26. The protuberant members 32 are preferably provided by a threaded fastener 64 and a resilient bushing 66. The threaded fasteners 64 are sized for fitting through the apertures 62 in the fan blade 25. The resilient bushings 66 are preferably sized for fitting snugly within the apertures 62 and fitting snugly over the bosses 70. Outer ends of the threaded fastener 64 and the bushing 66 will protrude outward of the apertures 62. The upper surface 36 of the C-connect fastener 24 is countersunk with a recess 50 located adjacent to and coaxially with the opening 46. The recess 50 defines a recessed surface 48 which is preferably separated from the upper surface 36 by a small space for receiving the head 72 of one of the threaded fasteners 64 and disposed adjacent to the openings 46. The recessed surface 48 will preferably engage directly against an annular shaped lower side of the head 72 of one of the threaded fasteners 64. (See FIGS. 4 and 5).

Figure 4:
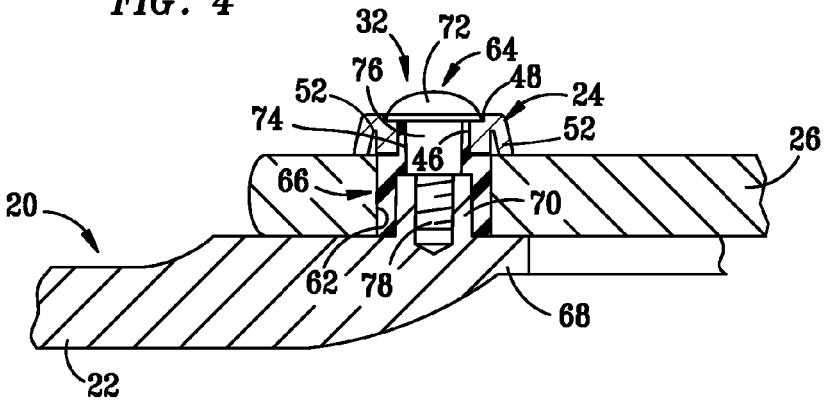

FIG. 4 is a partial section view of the fan blade 26, the mounting bracket arm 22, the protuberant member 32 and the C-connect fastener 24, taken along section line 4-4 of FIG. 2. The protuberant member 32 is shown as being provided by the threaded fastener 64 and the resilient bushing 66. The threaded fastener 64 has the head 72, which provides a head portion, and a shank 74, which provides a shank portion. The bushing 66 fits over the boss 70 of the mounting portion 68 of the mounting arm 22. The shank 74 of the threaded fastener 64 extends through the bushing 66 and is threadingly secured to the boss 70. The head 72 of the threaded fastener 64 fits within the recess 50 above the surface 48 adjacent to the C-shaped opening 46 in the threaded fastener 24. The head 72 is spaced apart above the upper surface of the fan blade 26 to provide an interference fit between the head 72, the upper surface of the fan blade 26, and the thickness of the C-connect fastener 24 between the recessed surface 48 and the lower surface 38. The resilient tab 52 of the C-connect fastener 24 is pressing against the upper surface of the fan blade 26, and increases the frictional engagement between the fan blade 26 and the C-connect fastener 24 in two ways. First, the resilient tab 52 presses the C-connect fastener 24 against the head 72 of the threaded fastener 64 at the recessed surface 48, to enhance both the interference fit of the thickness of the C-connect fastener 24 fitting between the head 72 of the threaded fastener 64 and the upper surface of the ceiling fan blade 26. Second, the resilient tab 52 presses against the surface of the fan blade 26 with greater force than if only a planar portion of the bottom 38 of the rotary plate member is disposed adjacent to the fan blade 26.

Figure 5:
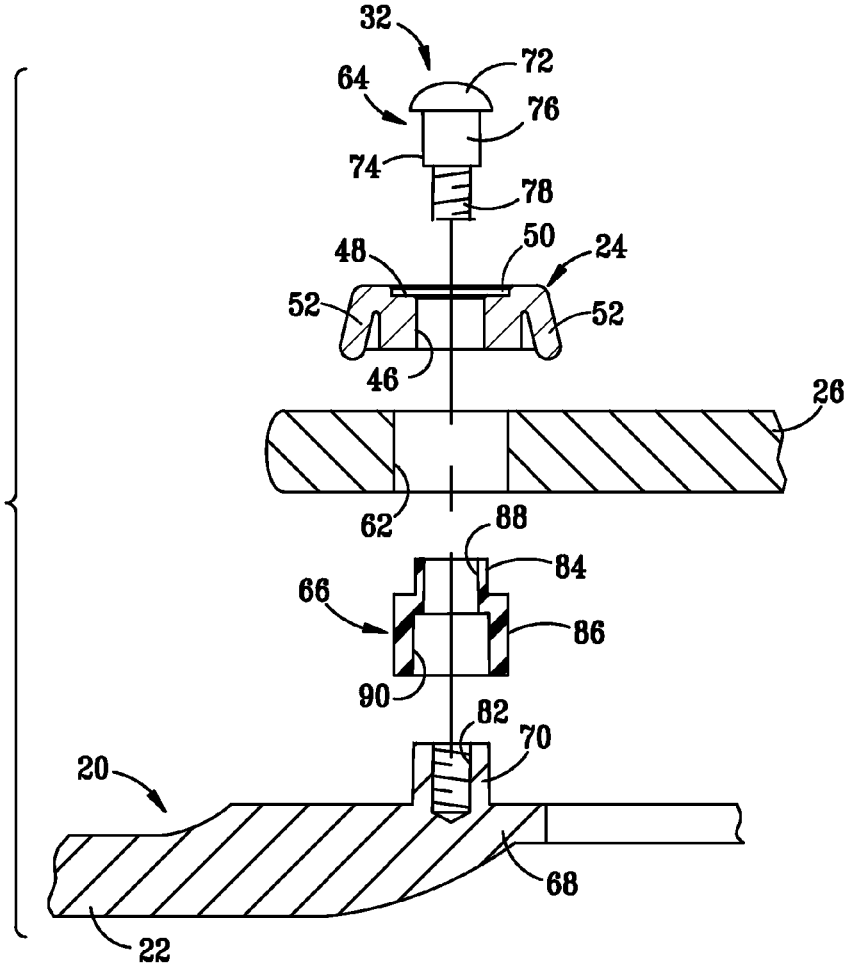

FIG. 5 is a partial, exploded, side elevation view taken along section line 4-4 of FIG. 2 showing the fan blade 26, the mounting bracket arm 22, the threaded fastener 64, the bushing 66 and the C-connect fastener 24. The shank 74 of the threaded fastener 64 preferably has an enlarged upper portion 76 and a threaded lower end portion 78. The boss 70 is formed on mounting portion 68 of the mounting bracket arm 22 with a threaded bore 82 for threadingly securing the threaded end portion 78 of the threaded fastener 64 thereto. The resilient bushing 66 is preferably formed of an elastomeric material, but may also be formed of non-resilient materials. In some embodiments, the protuberant member 32 may be provided without the bushing 66. The resilient bushing 66 includes a smaller outer diameter portion 84 for snugly fitting within the opening 46 in the C-connect fastener 24, and an enlarged outer diameter portion 86 for snugly fitting within the apertures 62 of the fan blade 26. The snug fit is provided by either an interference fit or a slight clearance between the bushing 66 and respective ones of the C-connect fastener 24 and the fan blade 26. The bushing 66 further includes a larger inner diameter 90 for receiving the boss 70, and a smaller inner diameter 84 for receiving the upper portion 76 of the shank 74 with the head 72 of the threaded fastener disposed above, and preferably adjacent to, the upper terminal end of the bushing 66.

Figure 6:
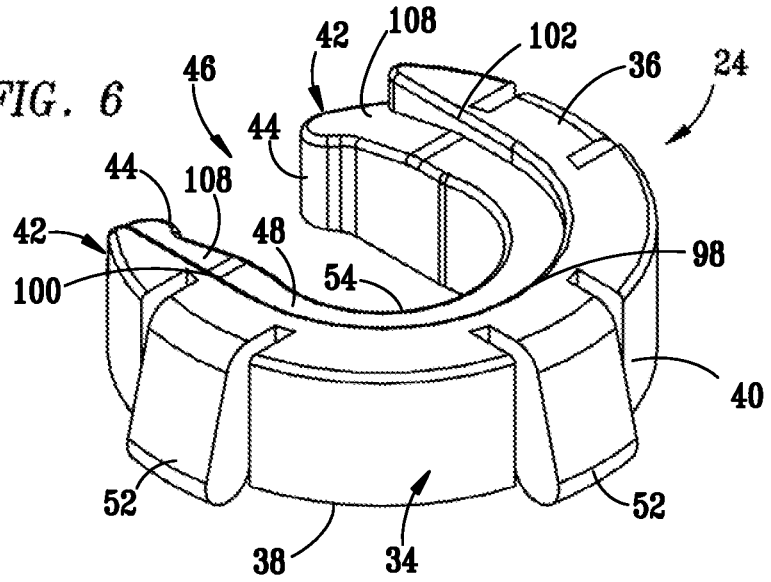
Figure 7:
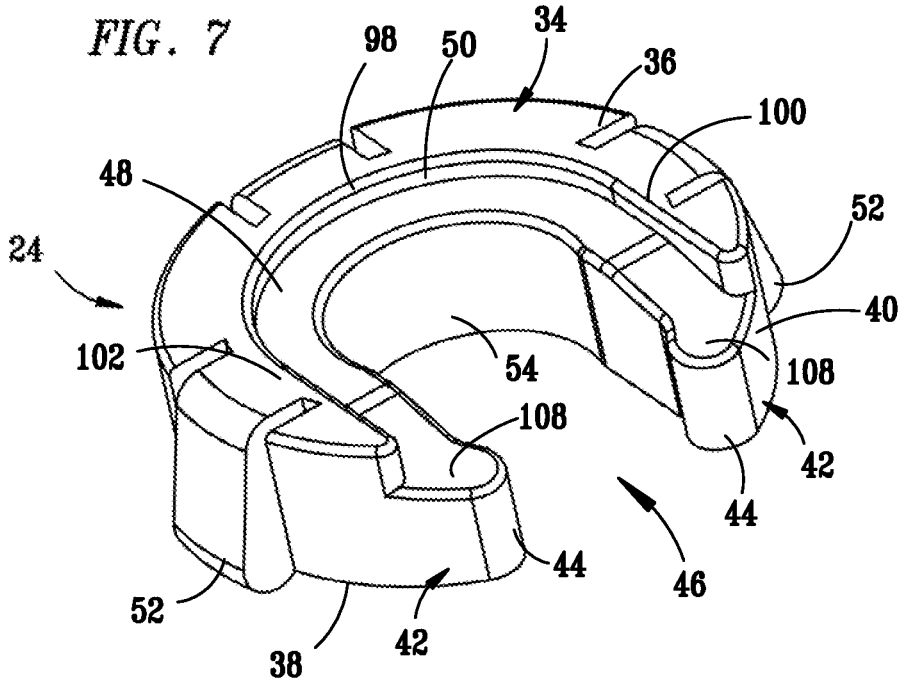
Figure 8:
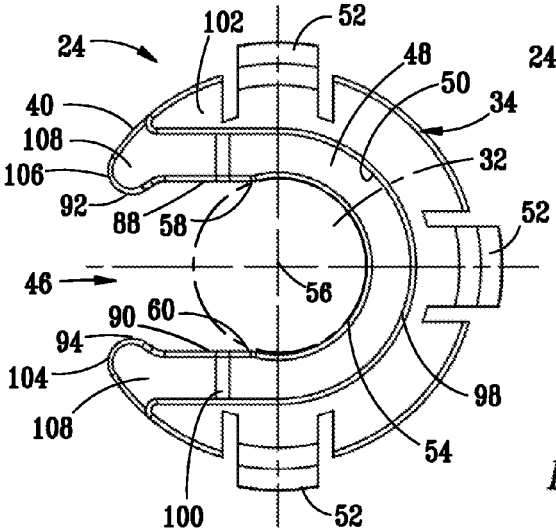
Figure 9:
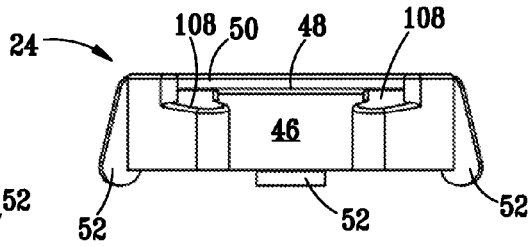
Figure 10:
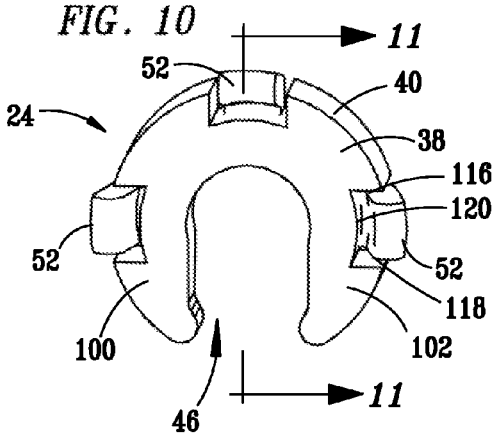

FIGS. 6 through 11 are views of the C-connect fastener 24, showing various features thereof. FIGS. 6 and 7 are perspective views, FIG. 8 is a top view, FIG. 9 is side view, and FIG. 10 is a perspective view looking upward at the bottom side of the C-connect fastener 24. The C-connect fastener 24 is preferably a plastic molded fastener having a body 34 which includes an upper surface 36, a lower surface 38 and a continuous peripheral edge 40. The continuous peripheral edge 40 is disposed between peripheral edges of the upper surface 36 and the lower surface 38, and includes the opening 46 and two peripheral edge portions 42 having guide surfaces 44. The peripheral edge 40 is preferably continuous, such that the edge 40 extends completely around the body 34 of the C-connect fastener 24. The opening 46 is preferably C-shaped and configured to extend a minimum of one-hundred eighty degrees around the protuberant member 32 when firmly fastening fan blades 26 to the mounting bracket 20. In the preferred embodiment, the opening 46 extends approximately two-hundred to two-hundred ten degrees around the protuberant members 32 when firmly fastening fan blades 26 to the mounting bracket 20. The opening 46 has one side which is closed, being defined by the exteriorly disposed peripheral edge 40 of the C-connect fastener 24, and an opposite side of the openings 46 which is open to the exterior of the C-connect fastener 24. The recessed surface 48 is formed into the upper surface 36 of the body 34 of the C-connect fastener 24, directly adjacent to the opening 46, such that the opening 46 extends from the recessed surface 48 to the lower surface 38 of the C-connect fastener 24. The body 34 of the C-connect fastener 24 preferably has two outward portions which define terminal ends 104 and 106 of respective sides of the opening 46.

FIG. 8 shows one of the protuberant members 32 disposed within the C-connect fastener 24, with the protuberant member shown in phantom. The peripheral edge portion 42 extends around the edge opening 46 and preferably has a semi-circular profile 54 which extends between points 58 and 60. The semicircular profile 54 preferably angularly extends approximately two-hundred to two-hundred ten degrees around a centerline 56 of the profile 54, preferably extending from the points 58 and 60, respectively, tangent to the recessed surface 48. The peripheral edge portion 42 further preferably includes two flats 88 and 90 which extend from the upper surface 36 to the lower surface 38 of the C-connect fastener 24 and provide an interference fit with shank portions of the protuberances 32, which are preferably provided by the smaller outer diameter portions 84 of the bushings 66. The interference fit between the flats 88 and 90, and the shank portions of the protuberances 32 provide a snap-fit when the protuberances 32 are fit within the edge openings 46. The C-shape of the body 34 defines two opposed arms 100 and 102 which extend in parallel from a connecting or web portion 98 of the C-shaped semicircular profile 54 extending between the two arms 100 and 102. The two arms 100 and 102 will spread apart when the shank 74 of the protuberant member 32 is passed there-between, and then will return to an original spacing once the shank 74 has passed through the flats 88 and 90 of the two arms 100 and 102. The outward terminal end 104 of the arm 100 and the outward terminal end 106 of the arm 102 each have protrusions 92 and 94, respectively. The protrusions 92 and 94 are disposed in opposed relation and extend inward into an outward end of the opening 46 to provide cam follower surfaces to spread the two arms 1000 and 102 apart when the shank 74 passes there-between. The shank 74 provides a cam to spread the two arms 100 and 102 apart.

Figure 11:
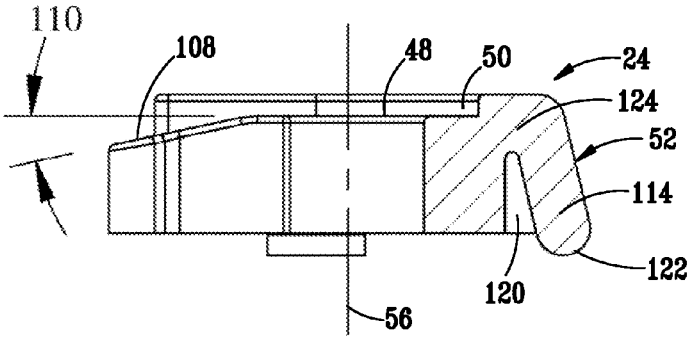

FIG. 11 is a partial, section view of the C-connect fastener 24, taken along Section Line 11-11 of FIG. 8, and shows the one of the resilient tabs 52 in more detail. The C-connect fastener 24 preferably has three resilient tabs 52, which are angularly spaced apart equal distances around a center portion of the body 34. The resilient tabs 52 preferably define portions of the peripheral edge 40, providing compression members, spring members, or friction detents, which extend downward and outward of the peripheral edge 40 and adjacent to the body 34 of the C-connect fastener 24. The resilient tabs 52 are elongated members for engaging an upper surface of the fan blade 26 to provide an upward force for enhancing the frictional engagement between the C-connect fastener 24, and the fan blade 26 and the protuberant members 32. The resilient tabs 52 each preferably have a first portion 124 which connects the resilient tabs 52 to the main portion of the body 34 and extends downward to an intermediate portion 53. The first portion 124 provides a pivot portion, or hinge portion, similar to a resilient living hinge, which will flex under force and then return to its original position when force is removed. The intermediate portion 114 extends downward to a terminal end 122 which engages against the upper surfaces of one of the fan blades 26. The resilient tabs 52 are of a length for providing a press fit between the C-connect fasteners 24 and the fan blades 26, such that the terminal ends 122 will press against the fan blades 26 to provide spring forces which push the C-connect fasteners 24 away from the fan blade 26 and into the head 72 of the protuberant members 32.

The resilient tabs 52 are defined by slots 116 and 118, and a slot 120, such that each of the resilient tabs 52 extend as a cantilevered projection from the main portion of the body 34 of the C-connect fastener 24. The two slots 116 and 118 extend into the body 34 to define spaces between opposite sides of the resilient tabs 52 and a main portion of the body 34. A slot 120 extends into the body 34, disposed between the main portion of the body 24 and defines an inward side of the resilient tab 52. The slot 120 defines a triangular shaped space which tapers in an upward direction and provides the resilient living hinge feature of the resilient tabs 52. The slots 116 and 118 separate the resilient tab 52 for moving relative to the body 34, and the slot 120 provides flexion of the resilient tab 52 to define a compression member for pressing recessed surface 48 of the C-connect fastener 24 into the head 72 of the protuberant member 32.

Two outward sections 108 of the recessed surface 48 located adjacent the terminal ends 104 and 106 are tapered, providing guide surfaces for guiding the head 72 of one of the protuberant members 32 into the recess 50 as the C-connect fastener 24 is wedged between the head and the surface of the blade 26. The outward sections 108 preferably taper at an angle 110 of twelve degrees to the horizontal, such that the peripheral edge 40 and thickness of the body 34 of the C-connect fastener 34 are reduced in size in moving outward toward the terminal ends 104 and 106 of the opposed arm sections 100 and 102.

The present invention provides C-connect fasteners for firmly fastening fan blades to mounting arms of ceiling fans. The C-connect fastener is preferably a single, molded plastic part having a C-shape which is configured for receiving a protuberant member which extends from the mounting bracket arm, through apertures in the ceiling fan blade, and protrudes outward of the ceiling fan blade. The protuberant members are preferably provided by threaded fasteners having respective shanks and heads. The protuberant member may also include a resilient bushing in some embodiments of the present invention. The C-connect fasteners preferably have resilient tabs for securing the C-connect fasteners from being removed from around the protuberant members.

Although the preferred embodiment has been described in detail, it should be understood that various changes, substitutions and alterations can be made therein without departing from the spirit and scope of the invention as defined by the appended claims.

What is claimed is:

1. An apparatus firmly fastening a fan blade to a bracket arm mounted to a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in the fan blade to extend outward of the fan blade on an opposite side of the fan blade from the bracket arm;

a C-connect fastener having an upper surface, a lower surface and a peripheral edge extending between said upper and lower surfaces, said peripheral edge portion having an opening which for registering adjacent to said shank portion of one of said protuberant members extending through the fan blade;

said peripheral edge including two flats defined to extend within said opening adjacent a portion of said opening shaped for receiving said shank portion of said protuberant member, wherein said flats are disposed in opposed relation spaced apart a distance which is smaller than a thickness of said shank portion; and wherein when said C-connect fastener is first moved to dispose said opening adjacent to said one of said protuberance members, and then pushed to move said openings around said shank portion of said one of said protuberant members, said C-connect fastener is pressed between said head portion of said one of said protuberant members and a surface of the fan blade; and wherein said C-connect fastener further comprises resilient tabs formed by slots extending to extend said peripheral edge of said C-connect fastener, wherein two of said slots are disposed adjacent to opposite sides of each of said resilient tabs and one of said slots is disposed between a main body of said C-connect fastener and an inwardly disposed side of each of said resilient tabs, and wherein said resilient tabs are configured to press against the fan blade when said C-connect fastener is wedged between the surface of the fan blade and said head of said protuberant member.

2. The apparatus according to claim 1, wherein said opening is at least in part C-shaped and extend a minimum of one-hundred and eighty degrees around a circumference of said shank portion of said one of said protuberant members.

3. The apparatus according to claim 1, wherein said peripheral edge of said C-connector is C-shaped when viewed perpendicular to said upper surface.

4. The apparatus according to claim 1, wherein said resilient tabs define elastic protrusions extending form an upper portion of said peripheral edge and downward to an elevation disposed beneath said lower surface of said C-connect fastener, and defining spring members with outward portions for pressing against the fan blade.

5. The apparatus according to claim 1, wherein said upper surface of said C-connect fastener has a countersunk portion for receiving said head portions of said one of said protuberant members.

6. The apparatus according to claim 1, wherein said peripheral edge further including two terminal end portions disposed outward of said two flats, said two terminal end portions each including two opposed protrusions which extend into said opening and engage said shank portion of said protuberant member to move said two flats apart starting said shank portion into aid opening.

7. The apparatus according to claim 1, wherein said protuberant members each comprise a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within said opening in said peripheral edge of said C-connect fastener.

8. An apparatus firmly fastening a fan blade to a bracket arm of a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in the blade to extend outward of the fan blade, on an opposite side of the fan blade from the bracket arm;

a C-connect fastener having an upper surface, a lower surface and a peripheral edge extending between said upper and lower surfaces, said peripheral edge having an opening which is aligned for registering adjacent to said shank portion of one of said protuberant members extending through the fan blade;

wherein said opening is at least in part C-shaped and extend a minimum of one-hundred and eighty degrees around a circumference of said shank portion of said one of said protuberant members;

said peripheral edge including two flats defined to extend within said opening adjacent a portion of said opening shaped for receiving said shank portion of said protuberant member, wherein said flats are disposed in opposed relation spaced apart a distance which is smaller than a thickness of said shank portion;

said peripheral edge further including two terminal end portions disposed outward of said two flats, said two terminal end portions each including two opposed protrusions which extend into said opening and engage said shank portion of said protuberant member to move said two flats apart starting said shank portion into aid opening;

said C-connect fastener further having resilient tabs which are formed by slots extending to extend said peripheral edge of said C-connect fastener, wherein two of said slots are disposed adjacent to opposite sides of each of said resilient tabs and one of said slots is disposed between a main body of said C-connect fastener and an inwardly disposed side of each of said resilient tabs, and wherein said resilient tabs are configured to press against the fan blade when said C-connect fastener is wedged between the surface of the fan blade and said head of said protuberant member; and wherein when said C-connect fastener is first moved to dispose said opening adjacent to said one of said protuberance members, and then pushed to move said openings around said shank portion of said one of said protuberant members, said C-connect fastener is pressed between said head portion of said one of said protuberant members and a surface of the fan blade.

9. The apparatus according to claim 8, wherein said peripheral edge of said C-connector is C-shaped when viewed perpendicular to said upper surface.

10. The apparatus according to claim 9, wherein said resilient tabs define elastic protrusions extending form an upper portion of said peripheral edge and downward to an elevation disposed beneath said lower surface of said C-connect fastener, and defining spring members with outward portions for pressing against the fan blade.

11. The apparatus according to claim 10, wherein said upper surface of said C-connect fastener has a countersunk portion for receiving said head portions of said one of said protuberant members.

12. The apparatus according to claim 8, wherein said countersunk portion defines a recessed surface for directly engaging said head portion of said protuberant member, said recesses surface having outward sections which taper to reduce a thickness of said C-connect fastener for fitting between said head portion and the surface of the fan blade when wedging said C-connect fastener there-between.

13. The apparatus according to claim 8, wherein said protuberant members each comprise a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within one of said opening in said peripheral edge of said C-connect fastener.

14. An apparatus firmly fastening a fan blade to a bracket arm mounted to a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in the fan blade to extend outward of the fan blade, on an opposite side of the fan blade from the bracket arm;

a C-connect fastener having an upper surface, a lower surface and a peripheral edge extending between said upper and lower surfaces, said peripheral edge having an opening which is aligned for registering adjacent to said shank portion of one of said protuberant members extending through the fan blade;

said peripheral edge including two flats defined to extend within said opening adjacent a portion of said opening shaped for receiving said shank portion of said protuberant member, wherein said flats are disposed in opposed relation spaced apart a distance which is smaller than a thickness of said shank portion;

said peripheral edge further including two terminal end portions disposed outward of said two flats, said two terminal end portions each including two opposed protrusions which extend into said opening and engage said shank portion of said protuberant member to move said two flats apart starting said shank portion into aid opening;

wherein said opening extends a minimum of one-hundred and eighty degrees around a circumference of said shank portion of said protuberant member, with at least one surface of said C-connect fastener disposed for engaging said head portion of said one of said protuberant members when said protuberant member is disposed within said opening;

said upper surface of said C-connect fastener having a countersunk portion for receiving said head portions of said one of said protuberant members, wherein said countersunk portion defines a recessed surface for directly engaging said head portion of said protuberant member, said recesses surface having outward sections which taper to reduce a thickness of said C-connect fastener for fitting between said head portion and the surface of the fan blade when wedging said C-connect fastener there-between;

wherein said protuberant members are defined by a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within one of said openings in said peripheral edge portions of said C-connect fastener; and wherein when said C-connect fastener is first moved to dispose said opening adjacent to said one of said protuberance members, and then pushed to move said openings around said shank portion of said one of said protuberant members, said C-connect fastener is pressed between said head portion of said one of said protuberant members and a surface of the fan blade; and further comprising said C-connect fastener having resilient tabs which extend from an upper portion of said peripheral edge and define elastic protrusions extending downward to an elevation disposed beneath said lower surface of said C-connect fastener defining spring members with outward portions for pressing against the fan blade; wherein said resilient tabs are formed by slots extending to extend said peripheral edge of said C-connect fastener, wherein two of said slots are disposed adjacent two opposite sides of each of said resilient tabs and one of said slots is disposed between a main body of said C-connect fastener and an inwardly disposed side of each of said resilient tabs; and wherein said resilient tabs are configured to press against the fan blade when said C-connect fastener is wedged between the surface of the fan blade and said head of said protuberant member.

15. The apparatus according to claim 14, wherein said opening in said peripheral edge of said C-connect fastener is C-shaped and said upper surface of said C-connect fastener has a countersunk portion for receiving said head portions of said one of said protuberant members.

* * * * *